United States Patent [19]

Gutmann

[11] 4,270,235

[45] Jun. 2, 1981

[54] ARM SUPPORT PILLOW

[76] Inventor: Gordon L. Gutmann, 207 Sparks Ave., Jeff, Ind. 47130

[21] Appl. No.: 958,859

[22] Filed: Nov. 8, 1978

[51] Int. Cl.[3] ..... A47C 21/00

[52] U.S. Cl. ..... 5/431; 5/436; 128/68; 269/328

[58] Field of Search ..... 5/431, 436, 437, 443, 5/445, 446, 503, 474; 128/68, 149, DIG. 6; 269/328

[56] References Cited

U.S. PATENT DOCUMENTS

| | | | |
|---|---|---|---|
| 561,562 | 6/1896 | Brownson . | |
| 830,776 | 9/1906 | Flagg . | |
| 885,243 | 4/1908 | Haas . | |
| 1,048,750 | 12/1912 | Smith . | |
| 2,658,211 | 11/1953 | Bendersky | 5/431 |
| 2,766,463 | 10/1956 | Bendersky | 5/465 |
| 3,005,212 | 10/1961 | Barnhill | 5/431 |
| 3,273,174 | 9/1966 | Cassini | 5/431 |
| 3,308,489 | 3/1967 | Winkler | 5/431 |
| 3,345,656 | 10/1967 | Steinman | 5/443 |
| 3,505,994 | 4/1970 | Smith | 128/80 R |
| 3,528,413 | 9/1970 | Aydt | 128/88 |
| 3,555,852 | 1/1971 | Radford | 5/436 |
| 3,678,926 | 7/1972 | Strittmatter | 5/437 |
| 3,903,878 | 9/1975 | Spann | 128/149 |
| 3,931,654 | 1/1976 | Spann | 5/443 |
| 3,946,451 | 3/1976 | Spann | 5/443 |

*Primary Examiner*—Casmir A. Nunberg

*Attorney, Agent, or Firm*—Beveridge, Degrandi, Kline & Lunsford

[57] ABSTRACT

A support device for the arms of convalescent patients for providing comfort and stability and for preventing circulation problems includes an inclined cushion provided with ridges on either side to prevent the arm from falling off and an angled shape to provide stability and comfort for the patient.

6 Claims, 3 Drawing Figures

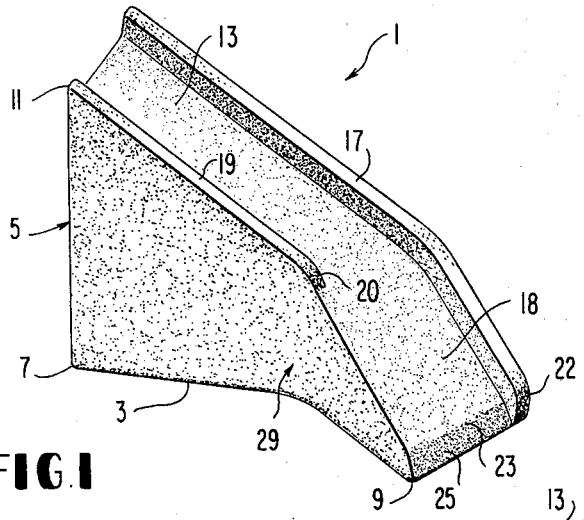
FIG. 1
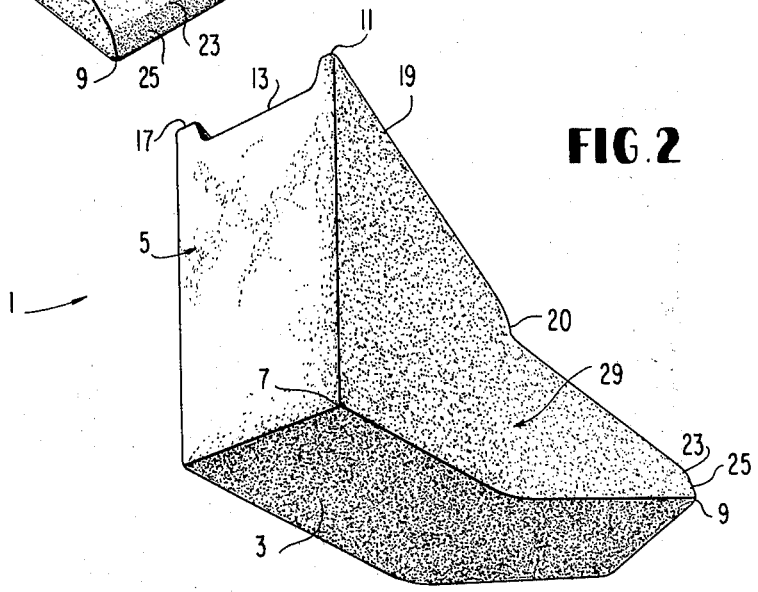
FIG. 2
FIG. 3
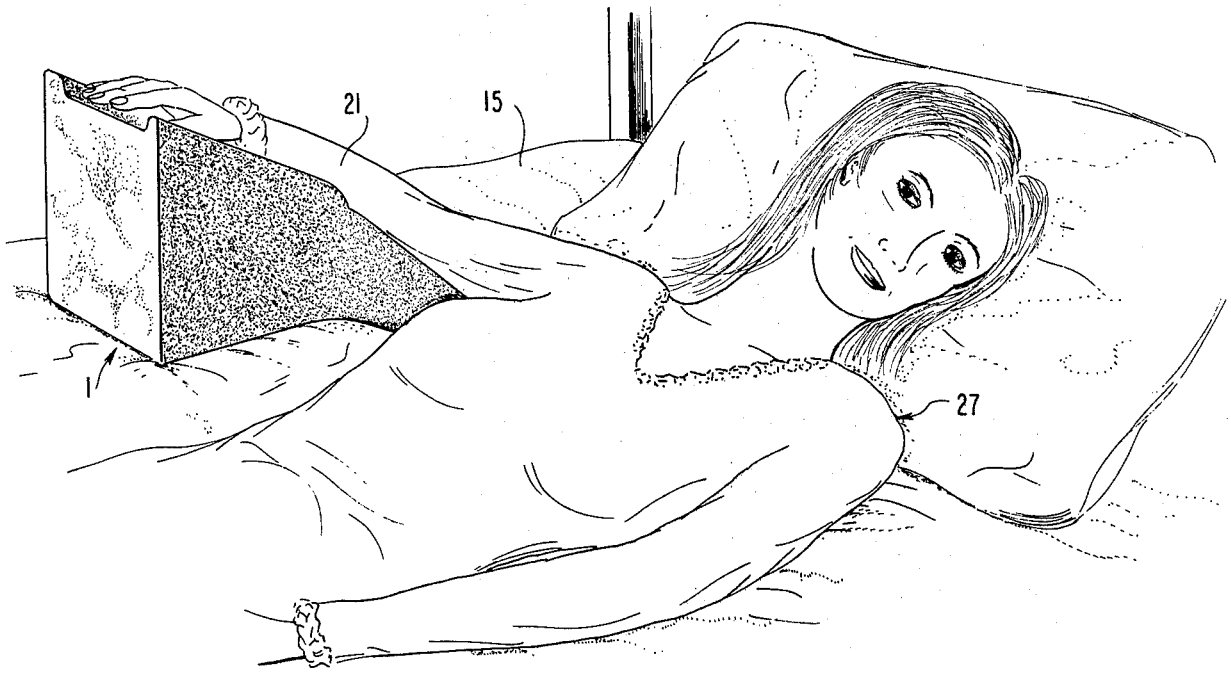

ARM SUPPORT PILLOW

BACKGROUND OF THE INVENTION

Post surgical convalescence is a difficult time not only for patients but also for doctors and hospital nurses. Patients must deal with pain, uncertainty, and discomfort. Doctors must watch for and prevent the complications arising from surgery. Nurses usually must deal with all of these problems on an intimate basis.

In particular, in mastectomies or other upper thoracical surgery, certain side effects from the surgery can cause further complications. Such surgery tends to inhibit return lymphatic and blood flow from the upper extremities and may tend to cause swelling and discomfort. This phenomenon is known as lymph-edema. Such swelling can be alarming for the patient, as well as uncomfortable. Also, such inhibition of circulation tends to retard convalescence.

In addition, if such upper extremities are moved, the patient will suffer pain and possible damage to the surgical area. It is desired therefore to maintain such upper extremities in a relatively stable position to prevent such damage and pain. If the upper extremity of the patient lies on the bed on which the patient lies, the desired stability may be maintained; however, the maintenance of the limb in a stationary position next to the patient on the level bed tends to aggravate lymph-edema. In hand operation cases, similar problems arise and special care must be taken to insure recovery of patients who have had hand surgery.

Thus, it can be seen that there is a need for a device which promotes lymphatic and blood flow so as to prevent the swelling of upper extremities and at the same time provide a stable, stationary support for the upper extremities which prevent undue movement thereof. It is the object of the present invention to achieve these results at minimal cost. The device of the present invention may be discarded after use by each patient thus helping to maintain sanitary conditions which are necessary in the post-operative stages of convalescance. Once the device of the present invention is employed there is little need to change the position of the upper extremity within it so that stability of position is effected. In addition, health care professionals can tell at a glace that the upper extremity is in the properly aligned position, thus freeing them from inordinate time commitments in attending to such details.

SUMMARY OF THE INVENTION

The present invention relates to a support device for facilitating circulation in an arm of a person lying on his back on a surface such as a hospital bed. The support device of the present invention can be made of any resiliant deformable material. The support device is a free standing device and has a substantially long and narrow configuration so as to support the arm of a patient along substantially the entire length of the arm, with only a slight thickness beyond the width of the typical adult patient's arm. Smaller devices can be fabricated for use with children. The width of the device at its base, however, is sufficent to provide stability when the support device stands freely on a bed. Additional stability is also provided by the angled shape of the device. The upper face of the support device is inclined along the entire length of the device. Thus, when the patient, in a reclined position, rests his arm on such a device, his hand will be near the upper-most elevated end of the device and his shoulder will be at the lower end of it, generally even with the base of the device resting on the bed surface. The upper face has an outer angled side and an inner angled side.

According to the preferred embodiment, the upper face of the device is provided with an outer ridge extending the entire length of the device and an inner ridge extending from the upper most height of the upper face a portion of the way down the upper face, with the inner and outer ridges extending above their respective inner and outer angled sides. A bend in the device at about $\frac{2}{3}$ of the way down the upperface, in the direction of the inner ridge provides a shape that naturally receives the arm of the patient, when bent at the elbow. The inner and outer ridges may be provided with rounded lower ends to increase the comfort of the patient. The upper face preferably has a lower end which is inclined from the bottom face by a greater amount than the main portion of the upper face. The angled shape of the base gives added stability to the entire device. It can be seen that this support device will then provide an elevated, stable position for the arm; i.e. the hand will be elevated with respect to the sholder of the patient. The elevation of the hand and wrist will facilitate lymphatic flow from the arm and thus prevent the discomfort and swelling of lymph-edema. By the use of such a bent support device having ridges on either side of the inclined upper face of the device, the patient can comfortably avoid the distress of lymph-edema and the hazards accompanying undue movement of the arms.

BRIEF DESCRIPTION OF THE DRAWINGS

The invention will be more readily understood from the reading of the following specification and by reference to the accompanying drawings forming a part thereof, wherein an embodiment of the invention is shown and wherein:

FIG. 1 is a perspective view from above illustrating a support device constructed in accordance with the present invention, FIG. 2 is a perspective view from below illustrating the same support device, and FIG. 3 is a perspective view of the support device in use by a patient lying on a bed.

DETAILED DESCRIPTION OF THE INVENTION

As shown in the drawings, the present invention relates to an arm support device 1 for elevating the arm of a patient while the drawings show a device for the right arm, it is equally possible, as will be apparent to those skilled in the art, to make such a device for use with the left arm. Device 1 is provided with a base 3 as a result of which the device is free standing and self supporting and which rests on bed 15. The length of device 1 from one end 7 to the other terminus 9 may vary as may be convenient. It has been found that the length should be approximately 23 inches; the taller end 5 of device 1 should be approximately 18 inches high from end 7 to point 11 although the height may be varied as may be convenient. Device 1 is provided with a generally concave upper face 13 for receiving and holding the arm of the patient. The concave surface may range from slightly concave to a high degree of concavity as may be convenient. Preferably the width of upper face 13 is about 5 inches or sufficiently wide to comfortably receive the arm of a patient. Running along the opposite side for about ⅔ of the length of the support device 1 is ridge 19. Preferably the lower edge 20 of ridge 19 and the lower edge 22 of ridge 17 are rounded so as to provide comfortable friction points for the arm 21 of patient 27. While upper face 13 is generally concave, it is provided with a discontinuity, or change in slope, 23 near its lower end. The portion 18 of upper face 13 is at a uniform inclination with respect to base 3. The steepness of upper face 13 is increased from discontinuity 23 to the terminus 9 of upper face 13. Thus lower end 25 is steeper than main portion 18. Device 1 has a bend 29 in the direction of ridge 19 located at the lower end 20 of ridge 19. It can be seen that bend 29 facilitates the bending of the elbow of patient 27 when device 1 is in use. Preferably, the angle of bend 29 is an obtuse angle of about 135°. However, the precise number of degrees of the obtuse angle may vary as convenient.

While the incline of device 1 provides the elevation of arm 21, ridges 17 and 19 provide stability to prevent arm 21 from rolling off of device 1 should patient 27 move arm 21. It is preferable to make the thickness of ridge 17 greater than the thickness of ridge 19, since the most damaging movement of arm 21 would be in the direction of ridge 17. Making ridge 17 especially thick would further prevent such rolling.

The device of the invention may be made of any suitable lightweight material such as natural or synthetic foam rubber, polyurethane foam, polystyrene foam and the like.

While a preferred embodiment of the inventions has been described using specific terms, such description is for illustrative purposes only, and it is understood that changes and variations may be made without departing from the spirit or scope of the following claims.

I claim:

1. A support device adapted for holding the arm of a person, comprising a body having a bottom support surface, and an upper face inclined upwardly at an angle from said bottom support surface and meeting said bottom surface at the lower end, a bend in said body, said bottom surface and said upper face, said bend forming an obtuse angle, said support being shaped so that the arm of said person can be inclined by placing said arm on said upper face with the shoulder at the lower end and the wrist and hand at the upper end.

2. A support device for facilitating circulation in an arm of a person lying on his back comprising;

a. a bottom support surface, b. an upper face inclined upwardly at an angle from said bottom support surface, having an outer angled side and an inner angled side and meeting said bottom surface at the lower end, c. an outer ridge extending above said outer angled side, along the entire length of said outer angled side, d. an inner ridge extending above said inner angled side of said upper face from the upper most height of said upper face a portion of the way down said upper face, e. a bend in said bottom surface, said upper face, and said outer ridge at about ⅔ of the way from the upper most height of said upper face to the lower most height of said upper face, wherein said bend is in the direction of said inner ridge, adapted to receive the arm of a person.

3. The support device of claim 2 wherein said outer ridge and said inner ridge have rounded lower ends.

4. The support device of claim 2 wherein said upper face has a lower end and a main portion, with said lower end inclined from said bottom face at a greater angle than said main portion.

5. The support device of claim 1 which is formed from a lightweight foam material.

6. The support device of claim 1 which is formed of polyurethene foam.

* * * * *